US007431024B2

(12) United States Patent
Buchwitz et al.

(10) Patent No.: US 7,431,024 B2
(45) Date of Patent: Oct. 7, 2008

(54) METHOD AND OPERATION OF AN ENGINE

(75) Inventors: James H Buchwitz, Strathcona, MN (US); Chad M Cunningham, Chisago City, MN (US); Nathan D Dahl, Salol, MN (US); Ryan W Sorenson, Roseau, MN (US); Dean J Hedlund, Roseau, MN (US); Christopher R Benning, Stacy, MN (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 11/445,731

(22) Filed: Jun. 2, 2006

(65) Prior Publication Data

US 2008/0041335 A1 Feb. 21, 2008

(51) Int. Cl.
*F02B 13/00* (2006.01)
*F02B 13/02* (2006.01)

(52) U.S. Cl. ..... 123/575

(58) Field of Classification Search ..... 123/304, 123/305, 299, 295, 21, 575, 576–578
See application file for complete search history.

(56) References Cited

U.S. PATENT DOCUMENTS 2,033,350 A * 3/1936 Murphy ..... 123/21
3,945,352 A 3/1976 Reimuller
3,946,711 A 3/1976 Wigal
4,094,288 A * 6/1978 Davis ..... 123/442
4,884,530 A 12/1989 Boekaus et al.
4,922,862 A 5/1990 Casacci
5,144,916 A 9/1992 Yoshida et al.
5,735,253 A 4/1998 Perotto et al.
5,755,211 A 5/1998 Koch
6,035,837 A 3/2000 Cohen et al.
6,213,086 B1 * 4/2001 Chmela et al. ..... 123/276
6,457,463 B1 10/2002 McChesney et al.
6,494,190 B1 12/2002 Cohen
6,543,423 B2 4/2003 Dobryden et al.
6,561,157 B2 * 5/2003 zur Loye et al. ..... 123/295
6,591,817 B2 7/2003 Deutsch
6,595,181 B2 * 7/2003 Najt et al. ..... 123/295
6,619,242 B2 * 9/2003 Kaneko ..... 123/21

(Continued)

FOREIGN PATENT DOCUMENTS

DE 2154341 5/1973

(Continued)

OTHER PUBLICATIONS

International Search Report and Written Opinion for PCT/US2007/070220, 6 pages.

*Primary Examiner*—Mahmoud Gimie
(74) *Attorney, Agent, or Firm*—Baker & Daniels LLP

(57) ABSTRACT

An engine is disclosed which may operate in a first operating state wherein a spark ignited fuel is ignited in a combustion chamber with an igniter and a second operating state wherein a compression ignited fuel is ignited in a combustion chamber with an igniter. A compression ratio in the combustion chamber being up to about eight to one. The engine may be a four-stroke engine. The engine may include a piston having a top portion with a recessed central portion.

35 Claims, 3 Drawing Sheets

U.S. PATENT DOCUMENTS

| | | | | |
|---|---|---|---|---|
| 6,684,849 | B2 * | 2/2004 | zur Loye et al. | 123/295 |
| 6,767,022 | B1 | 7/2004 | Chevalier | |
| 6,845,608 | B2 | 1/2005 | Klenk et al. | |
| 6,907,870 | B2 * | 6/2005 | zur Loye et al. | 123/594 |
| 7,004,484 | B1 | 2/2006 | Chevalier | |
| 2001/0047777 | A1 * | 12/2001 | Allen | 123/73 C |
| 2002/0116918 | A1 * | 8/2002 | Morikawa et al. | 60/285 |
| 2002/0117126 | A1 * | 8/2002 | Kaneko | 123/21 |
| 2002/0157619 | A1 | 10/2002 | Gray | |
| 2003/0062021 | A1 * | 4/2003 | Najt et al. | 123/295 |
| 2003/0131805 | A1 * | 7/2003 | Yang | 123/27 R |
| 2003/0168037 | A1 * | 9/2003 | zur Loye et al. | 123/295 |
| 2005/0072407 | A1 | 4/2005 | Yu | |
| 2005/0098148 | A1 * | 5/2005 | Kuzuyama et al. | 123/315 |
| 2005/0139178 | A1 * | 6/2005 | Scuderi | 123/70 R |
| 2007/0113541 | A1 * | 5/2007 | Jankovic | 60/285 |

FOREIGN PATENT DOCUMENTS

| | | |
|---|---|---|
| GB | 796014 | 6/1958 |

* cited by examiner

METHOD AND OPERATION OF AN ENGINE

FIELD OF THE INVENTION

The present invention relates to internal combustion engines and vehicles powered by internal combustion engines and in particular to four-stroke internal combustion engines having a first operating state running on a spark ignition fuel and a second operating state running on a compression ignition fuel and vehicles powered by the same.

BACKGROUND OF THE INVENTION

Four-stroke internal combustion engines are known. Typically, these engines run on either a spark ignition fuel ("SI fuel"), such as gasoline, or a compression ignition fuel ("CI fuel"), such as diesel fuel. The primary difference between CI fuels and SI fuels is the range of boiling points, otherwise known as a distillation curve and the ignition temperature. CI fuels have distillation curves above 150° C. and ignition temperatures of approximately 250° C. Exemplary CI fuels include diesel fuel, JP8, JP5, Jet-A, and kerosene. Standard automotive diesel fuel has a distillation curve in the range of 180° C. to 360° C. with an ignition temperature of approximately 250° C. SI fuels have distillation curves starting below 150° C. and ignition temperatures in the range of approximately 300° C. to 500° C. An exemplary SI fuel is premium automotive gasoline which has a distillation curve in the range of 25° C. to 215° C. with an ignition temperature of approximately 400° C.

Engines which utilize SI fuels are often used for smaller applications because such engines are generally lower cost, create less noise and vibration, do not require as heavy duty of components thereby reducing the size and weight, and typically have a higher speed range resulting in less shifting required during operation of a vehicle. Engines which utilize CI fuels are generally used for larger applications and include heavier duty components and offer the advantage of increased fuel economy, engine lifespan, and specific torque output.

Engines utilizing a CI fuel typically have a compression ratio in the range of 12:1 to 22:1. The term compression ratio as used herein being defined as the ratio of maximum volume of the combustion chamber (when the piston is at its farthest location from a top portion of the combustion chamber or the bottom of its stroke) to the minimum volume of the combustion chamber (when the piston is at its closest location from a top portion of the combustion chamber or at the top of its stroke). Engines utilizing a SI fuel typically have a compression ratio in the range of 8:1 to 12.5:1. Low power, air cooled engines and industrial engines that utilize a SI fuel are known to have compression ratios as low as 6:1.

Situations arise wherein the fuel source available does not match the fuel type required by an engine. For example, during military campaigns many different types of vehicles are often employed, some having internal combustion engines that require gasoline and some having internal combustion engines that require diesel fuel. As the campaign continues these vehicles often travel to locations more and more remote from the main fuel supply of either gasoline or diesel fuel. As such, fuel transports, such as tanker trucks, must carry the fuel supply to the remotely located vehicles for refilling a fuel tank on the vehicle. If the remotely located vehicles include both gasoline powered vehicles and diesel powered vehicles, then both gasoline and diesel must be carried by the tanker trucks. This often results in requiring additional tanker trucks, some to transport gasoline and some to transport diesel fuel.

SUMMARY OF THE INVENTION

In an exemplary embodiment of the present invention, a four-stroke engine is provided which may utilize either a SI fuel or a CI fuel. In another exemplary embodiment of the present invention, an engine is provided having a piston with a recess in a top portion to receive non-ignited fuel.

In a further exemplary embodiment, a vehicle for transporting a person is provided. The vehicle including a chassis, a traction device adapted to contact the ground and propel the chassis, a fuel supply supported by the chassis and adapted to receive a SI fuel and a CI fuel, and a four-stroke engine supported by the chassis and providing power to the traction device. The four-stroke engine having an intake stroke, a compression stroke, a combustion stroke, and an exhaust stroke, the engine having a first operating state running on SI fuel and a second operating state running on CI fuel. The four-stroke engine including an engine base, a piston, and an igniter, the engine base and the piston cooperating to define a combustion chamber in communication with the fuel supply and igniter. In an example, during the second operating state, the temperature of the CI fuel in the combustion chamber is below an ignition temperature of the CI fuel during the entirety of the compression stroke. In another example, a compression ratio in the combustion chamber is less than eight to one. In a further example, a compression ratio in the combustion chamber is up to about eight to one. In a variation, the compression ratio in the combustion chamber is at least about six to one.

In yet another exemplary embodiment of the present invention, a vehicle for transporting a person is provided. The vehicle including a chassis, a traction device adapted to contact the ground and propel the chassis, a fuel supply supported by the chassis, and an engine supported by the chassis. The engine including an engine base having a cavity disposed therein; a piston received within the cavity and slideably moveable within the cavity, the piston including a top portion having a periphery and a central section, the central section being lower than the periphery, a fuel injector configured to introduce a combustible charge into a combustion chamber formed in the cavity between the top portion of the piston and the engine base; and an igniter in communication with the combustion chamber. The igniter configured to ignite the combustible charge within the combustion chamber. In an example, the combustible charge includes a SI fuel and the compression ratio of the engine is up to about eight to one. In another example, the vehicle further comprises a controller operably coupled to the fuel injector and the igniter and a sensor configured to provide an indication to the controller of a fuel type present in the combustion charge. The controller configured to time the introduction of the combustible charge into the combustion chamber and the ignition of the combustible charge with the igniter.

In yet a further exemplary embodiment of the present invention, a method of operating an engine is provided. The method including the step of moving a piston away from a top portion of a combustion chamber and introducing a combustible charge into the combustion chamber during an intake stroke, the combustible charge including a CI fuel. The method further including the steps of moving the piston towards the top portion of the combustion chamber during a compression stroke; igniting the combustible charge in the combustion chamber with an igniter thereby moving the piston away from the top portion of the combustion chamber during a combustion stroke, the combustible chamber having a compression ratio of up to about eight to one; and moving the piston towards the top portion of the combustion chamber during an exhaust stroke.

In still a further exemplary embodiment of the present invention, a method of operating an engine is provided. The method including the steps of introducing a charge into a combustion chamber of the engine; igniting a first portion of the charge in the combustion chamber with an igniter, a second portion of the charge in the combustion chamber not being ignited; exhausting gases generated from the previously ignited first portion of the charge from the combustion chamber; and receiving the second portion of the charge in a recess in a top portion of a piston which bounds the combustion chamber.

In still another exemplary embodiment of the present invention, a method of operating an engine is provided. The method including the steps of receiving an indication of a fuel type being provided to a combustion chamber of the engine, the fuel type being one of a SI fuel and a CI fuel; compressing a charge in the combustion chamber, a compression ratio of the combustion chamber being up to about eight to one; and igniting the compressed fuel in the combustion chamber.

The above mentioned and other features of this invention, and the manner of attaining them, will become more apparent and the invention itself will be better understood by reference to the following description of embodiments of the invention taken in conjunction with the accompanying drawings.

BRIEF DESCRIPTION OF THE DRAWINGS

Corresponding reference characters indicate corresponding parts throughout the several views. Unless otherwise stated herein, the figures are proportional.

DETAILED DESCRIPTION OF EMBODIMENTS OF THE INVENTION

The embodiments disclosed below are not intended to be exhaustive or to limit the invention to the precise forms disclosed in the following detailed description. Rather, the embodiments are chosen and described so that others skilled in the art may utilize their teachings. For example, the vehicle of the following description is an all-terrain vehicle ("ATV"). It should be understood, however, that the invention may have application to other types of vehicles such as snowmobiles, watercraft, utility vehicles, motorcycles, scooters, and mopeds.

Figure 1:
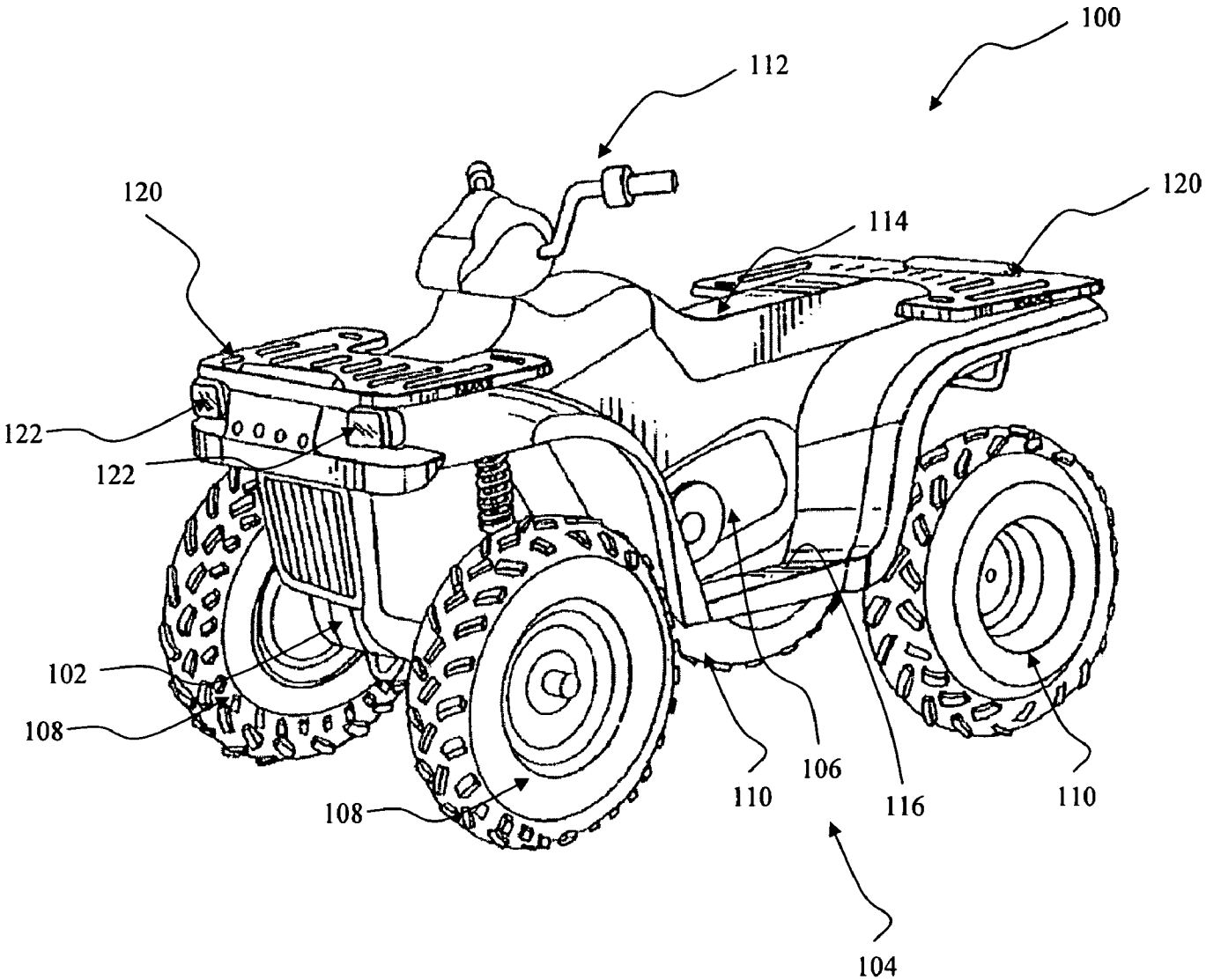
FIG. 1 is a perspective view of an exemplary vehicle, an ATV.

FIG. 1 is a perspective view of an exemplary vehicle, an ATV 100. ATV 100 includes a chassis 102, a traction device 104 coupled to chassis 102, and an engine 106 supported by chassis 102. Traction device 104 includes two front wheels 108 and two rear wheels 110. In one embodiment, each of front wheels 108 is coupled to chassis 102 by a front suspension (not shown) and each of rear wheels 110 is coupled to chassis 102 by a rear suspension (not shown). A set of handle bars 112 are supported by chassis 102 and are coupled to front wheels 108 for steering ATV 100. Each of the front wheels 108 and rear wheels 110 have a contact point with the ground. Other types of traction devices may be used such as tracks and other suitable traction devices.

ATV 100 also includes a straddle-type seat 114 and foot rests 116 on each side of seat 114 (only one shown) for use by a rider of ATV 100. ATV 100 also includes headlights 122 and front and rear platforms or racks 120 for supporting cargo. Additional details about an exemplary ATV may be found in U.S. Pat. Nos. 7,004,484; 7,000,931; 6,981,695; 6,092,877; and 5,975,624, the disclosures of which are expressly incorporated by reference herein.

Figure 2:
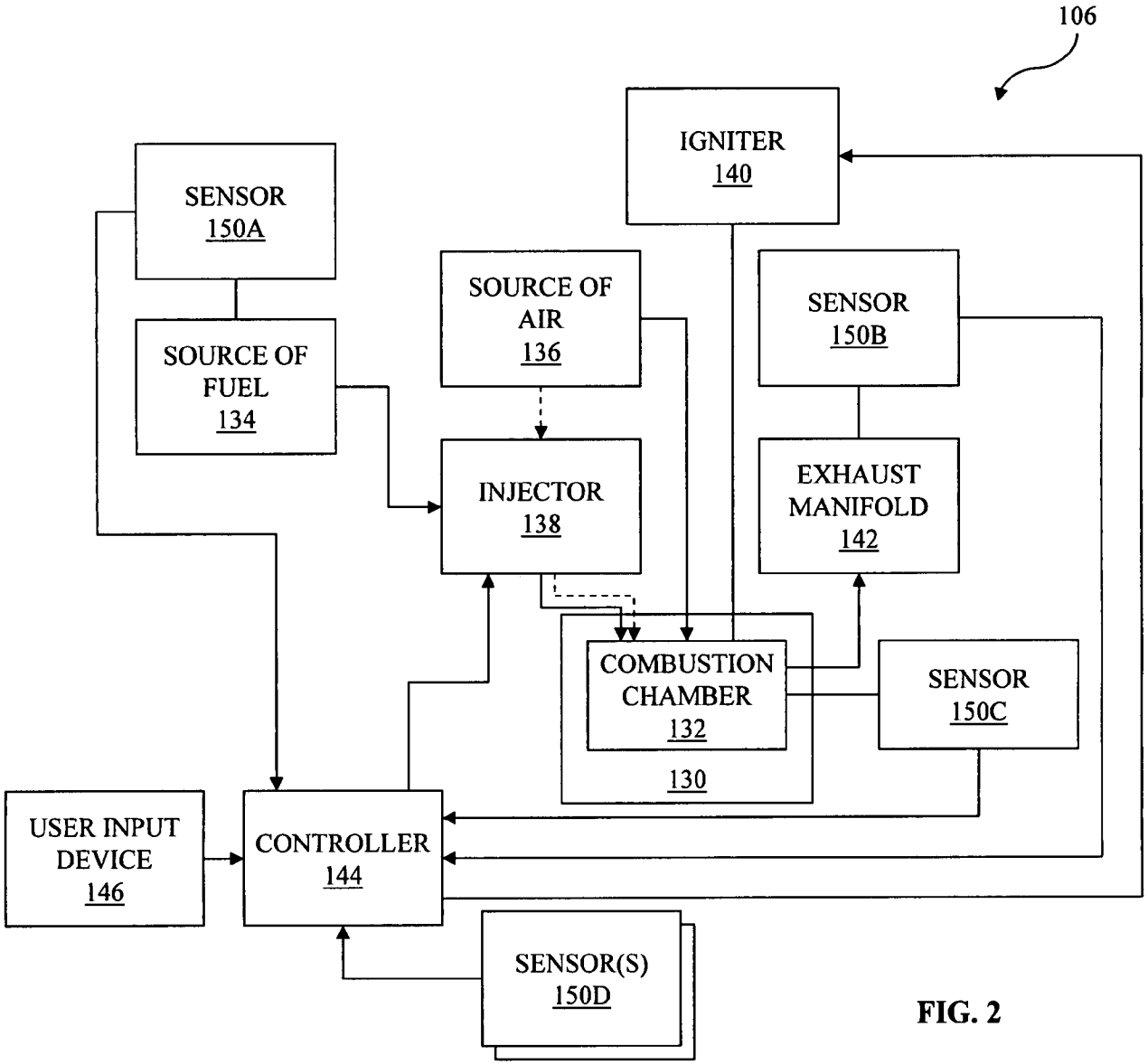
FIG. 2 is a diagrammatic representation of selected components of the exemplary vehicle of FIG. 1.

A diagrammatic representation of engine 106 is shown in FIG. 2. Engine 106 includes an engine base 130 which includes a combustion chamber 132 there within. Engine base 130, in one embodiment, includes an engine block and a cylinder head and combustion chamber 132 is defined by the engine block, the cylinder head, and a top portion of a piston which is moveable within a cavity of the engine base.

Although engine 106 is described in relation to a single combustion chamber 132, it should be understood that engine 106 includes multiple combustion chambers 132 each of which receives fuel and air and expels exhaust gases. As is understood in the art, the positioning of the respective pistons in each combustion chamber 132 may be offset and out of phase, such that the combustion stroke of one or more pistons drives a crankshaft which in turn drives the remaining pistons and provides power to traction device 104 through a transmission (not shown).

Combustion chamber 132 is in fluid communication with a source of fuel 134, such as a fuel tank, and a source of air 136. An exemplary source of fuel is a fuel tank which provides fuel to a fuel injector 138 which injects a quantity of fuel into the combustion chamber 132 to be ignited. An exemplary source of air is an air intake which provides air to combustion chamber 132, in one embodiment, through an intake valve or, in another embodiment, through fuel injector 138 as compressed air.

In one embodiment, injector 138 is an air assisted, direct fuel injector which injects fuel directly into combustion chamber 132 with the assistance of compressed air which acts as a propellant. The compressed air finely atomizes and/or vaporizes the fuel to create a stable, easily ignitable fuel/air spray which burns more completely. The air assisted fuel injector 138 may be used with CI fuels and/or SI fuels. The term atomization refers to a fuel spray that breaks the injected fuel into generally as many droplets as possible thereby increasing the surface area of the liquid fuel. For SI fuels, the liquid fuel must be vaporized to combust. The smaller the droplet size the faster the SI fuel will vaporize. As such, the larger the droplet size the longer the time required for the liquid SI fuel to vaporize thereby resulting in a poor combustion and/or no combustion.

The air and fuel introduced in combustion chamber 132, also referred to as "the charge," is ignited by an igniter 140. In one example, the igniter includes a sparkplug. The ignition of the charge results in the generation of exhaust gases which are exhausted through an exhaust manifold 142. By using igniter 140, the speed range of engine 106 is not diminished regardless of whether a SI fuel or a CI fuel is utilized because the design of the engine 106 is based on a SI engine design that uses lighter duty components than a similar CI engine design whose heavy duty components can limit the engine speed range. The transmission (not shown) of vehicle 100 is attuned to the speed range of engine 106. As such, by maintaining the speed range of engine 106 for both SI fuels and CI fuels, vehicle 100 may operate on either fuel.

In one embodiment, engine 106 is a four-stroke engine. In operation, engine 106 includes an intake stroke wherein air and fuel are provided or drawn into combustion chamber 132. During the intake stroke, the piston moves away from a top portion of combustion chamber 132. The intake stroke is followed by a compression stroke wherein the air and fuel present in combustion chamber 132 are compressed. During the compression stroke, the piston moves towards the top portion of combustion chamber 132 thereby reducing the volume of combustion chamber 132 and compressing the air and fuel in combustion chamber 132. The compression stroke is followed by a combustion stroke wherein the fuel and air are ignited with igniter 140. During the combustion stroke the piston moves away from the top portion of combustion chamber 132 due to the expanding gases from the ignition of the fuel and the air. The combustion stroke is followed by an exhaust stroke wherein the gases produced during the combustion stroke are expelled from combustion chamber 132. During the exhaust stroke, the piston moves towards the top portion of the combustion chamber 132 forcing the gases produced during the combustion stroke out through exhaust manifold 142.

In one embodiment, engine 106 operates with a compression ratio in the range of about 6:1 to about 8:1 for both a first operating state wherein a SI fuel is provided to combustion chamber 132 and a second operating state wherein a CI fuel is provided to combustion chamber 132. In another embodiment, engine 106 operates with a compression ratio of up to about 6:1, about 6:1 up to about 8:1, or about 8:1 for both a first operating state wherein a SI fuel is provided to combustion chamber 132 and a second operating state wherein a CI fuel is provided to combustion chamber 132. By lowering the compression ratio to the ranges provided herein, the CI fuel in combustion chamber 132 should not detonate prior to being electrically ignited by igniter 140. Further, in the second operating state the temperature of the CI fuel in combustion chamber 132 is kept below its ignition temperature during the compression stroke, such that the CI fuel does not detonate prior to ignition by igniter 140. In one example, the temperature of the CI fuel is kept below about 250 ° C.

As stated above, engine 106 is configured to operate in a first exemplary operating state wherein the fuel provided to combustion chamber 132 is an SI fuel and a second exemplary operating state wherein the fuel provided to combustion chamber 132 is a CI fuel. The operation of engine 106 is governed by a controller 144. Controller 144, in one embodiment, controls the operation of injector 138 and igniter 140. As such, controller 144 may control the blend of fuel and air in combustion chamber 132, the timing of the introduction of the fuel and/or air into combustion chamber 132, and the timing and/or length of the ignition of the fuel and air in combustion chamber 132 by igniter 140. An exemplary controller is an engine management system.

In one embodiment, a user input device 146 is provided. User input device 146 provides an indication to controller 144 of the type of fuel that is stored in source of fuel 134. In one embodiment, user input device 146 includes a first setting for a CI fuel and a second setting for a SI fuel. In other embodiments, user input device 146 may include specific settings for particular types of SI fuels and/or CI fuels. Exemplary user input devices include a dial, a push-button, and a digital input.

In one embodiment, a sensor 150 is provided which monitors a property or condition of the fuel or other indicator thereof. Sensor 150 provides an indication of the property or condition to controller 144. A first sensor 150A is shown in connection with source of fuel 134. Sensor 150A measures a physical property of the fuel in or being supplied by source of fuel 134. This physical property may be used by controller 144 to determine the fuel composition. An exemplary sensor 150A is a capacitive sensor. The electrical capacitance difference between gasoline, kerosene, and diesel fuels may be detected by a capacitance sensor. Controller 144 monitors the capacitance of the capacitive sensor and determines the type of fuel based on the capacitance.

In one embodiment, engine 106 may run on a mixture of two or more fuels. In one example, engine 106 is able to run on a mixture of gasoline and diesel. As such, fuel source 134 may be refilled with either diesel or gasoline regardless of the current fuel in fuel source 134 and engine 106 may run on the resultant mixture. This permits the utilization of the fuel source currently on hand for refueling. In one embodiment, a sensor, such as the sensors discussed herein, provides an indication of the fuel mixture being used by engine 106. Controller 144 may then adjust the operation of engine 106 based on the fuel mixture. Exemplary sensors include E85 vehicle fuel sensors can measure the percentage of ethanol in the fuel.

A second sensor 150B is shown in connection with exhaust manifold 142. Sensor 150B measures a characteristic of the exhaust gases, such as the level of oxygen in the exhaust gas and/or the fuel/air ratio of the combustion of the exhaust gases. CI fuels, such as kerosene, have a higher density than SI fuels, such as gasoline. Due to the higher density of CI fuels, a greater mass of CI fuel as compared to a SI fuel will be injected into combustion chamber 132 for the same time period. The additional mass of injected CI fuel, for a given injector energization time, will result in an increase in the fuel/air ratio. Sensor 150B will detect the increased fuel/air ratio in the exhaust gases and based thereon controller 144 will determine that the fuel being ignited is a CI fuel and/or the particular type of CI fuel. In one embodiment, controller 144 compares the measured fuel/air ratio for the specified injection time to known fuel/air ratios for the specified injection time which are correlated to fuel compositions.

In one embodiment, fuel injector 138 is controlled by controller 144 using a time based control. Due to the higher density of CI fuels, a greater mass of CI fuel as compared to a SI fuel will be injected into combustion chamber 132 for the same time period. The additional mass of injected CI fuel, for a given injector energization time, will result in an increase in the fuel/air ratio. Sensor 150B will detect the increased fuel/air ratio in the exhaust gases and based thereon controller 144 will determine that the fuel being ignited is a CI fuel and/or the particular type of CI fuel. In one embodiment, controller 144 compares the measured fuel/air ratio for the specified injection time to known fuel/air ratios for the specified injection time which are correlated to fuel compositions.

Sensor 150B may also be used to differentiate between different types of CI fuels and/or SI fuels. For example, standard diesel fuel has a higher density than kerosene based fuels. As such, controller 144 may distinguish between diesel and kerosene. In one embodiment, sensor 150B is a lambda sensor.

A third sensor 150C is shown in connection with combustion chamber 132. Sensor 150C measures the occurrence of fuel detonation in combustion chamber 132. Once a fuel is ignited in combustion chamber 132, the burning of the fuel spreads to unburned portions of the fuel. In some instances, a portion of the unburned fuel may detonate prior to the desired timing of ignition. This detonation may be classified as engine knock and differs based on the type of fuel being ignited in compression chamber 132. For instance, CI fuels, such as kerosene, have a greater tendency to knock than SI fuels, such as gasoline. Further, specific CI fuels and/or SI fuels may be distinguished on their knock characteristics. For instance, diesel fuels have a greater tendency to knock than kerosene-based fuels. By comparing the timing of a detection of a knock by sensor 150C to the ignition timing, controller 144 may determine the fuel composition based on known knock characteristics of various fuels. Further, when a knock is detected, controller 144 may retard the ignition timing to eliminate and/or reduce the knock in future ignitions.

Controller 144 may use one or more of sensors 150A-C and/or user input 146 to determine the type of fuel being utilized by engine 106. Further, controller 144 may alter one or more parameters of engine 106, including the injector energization time and/or the timing of the ignition with igniter 140 for each piston based on the determined fuel type and/or monitored characteristics of engine 106, such as with sensors 150A-C. Sensor(s) 150D represent additional sensors that may provide input to controller 144 and may include a crankshaft and/or camshaft angle sensor, a sensor monitoring airflow into the engine, a throttle position sensor, and/or other suitable sensors.

In one embodiment, based on the monitored parameters with one or more of sensor 150A-D, controller 144 may determine which combustion chamber 132 needs fuel, the quantity of fuel needed, operate the respective injector 138 to provide the fuel, time an ignition with igniter 140, and a duration of the ignition with igniter 140. In one embodiment, controller 144 also alters a combustion pattern of the fuel in combustion chamber 132 based on operating conditions of engine 106, such as load and revolutions per minute. In one example, controller 144 provides a stratified injection pattern wherein a reduced volume of fuel and air mixture is directed around the igniter 140 resulting in combustion only occurring in a portion of the combustion chamber 132. In another example, controller 144 provides a homogeneous injection pattern wherein the entire combustion chamber 132 is a homogenous mixture of fuel and air.

Figure 3:
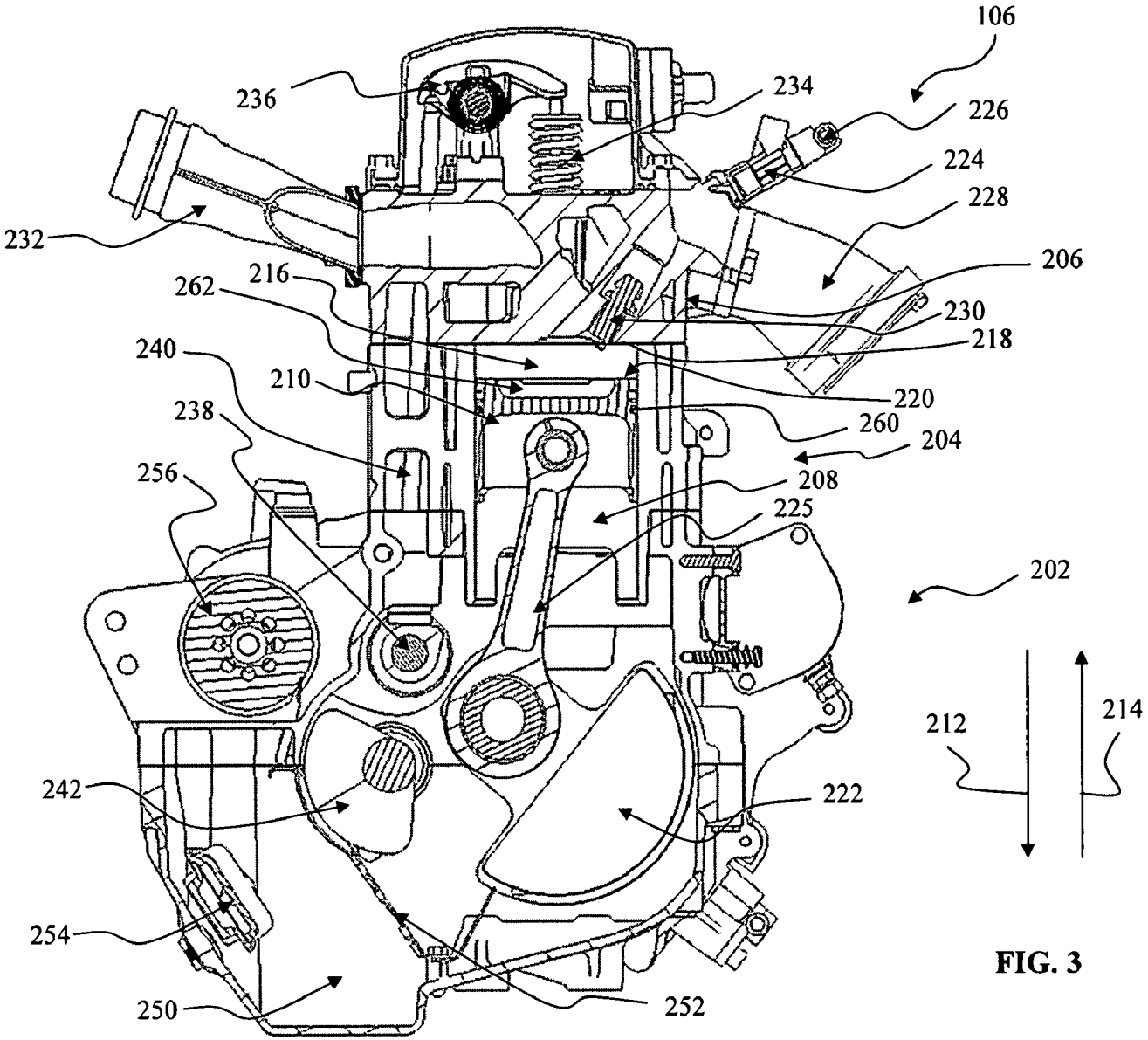
FIG. 3 is a sectional view of an exemplary embodiment of the engine of the vehicle of FIG. 1.

Referring to FIG. 3, an exemplary engine 200 is shown. Engine 200 functions in accordance with the above description of engine 106. Engine 200 includes an engine base 202. Engine base 202 includes an engine block 204 and a cylinder head 206. Engine block 204 includes a generally vertically oriented cylinder 208 which is sized to receive a piston 210 which is moveable generally in directions 212 and 214 within cylinder 208.

A region between a lower surface 218 of cylinder head 206 and an upper portion 220 of piston 210 defines a combustion chamber 216. Combustion chamber 216 has a minimum volume when piston 210 is moved to its farthest extent in direction 214 and has a maximum volume when piston 210 is moved to its farthest extent in direction 212. As shown in FIG. 3, piston 210 is coupled to a crankshaft through a connecting rod 225. Piston 210 is moved in direction 214 due to a force applied to piston 210 by crankshaft 222. Piston 210 is moved in direction 212 due to either a force applied to piston 210 by crankshaft 222 or due to the expanding gases in combustion chamber 216 during and/or following the ignition of a charge in combustion chamber 216.

In one embodiment, engine 200 is a four-stroke engine. In operation, engine 200 includes an intake stroke wherein air and fuel are provided or drawn into combustion chamber 216. During the intake stroke, piston 210 moves away from top surface 218 of cylinder head 206 in direction 212. The movement of piston 210 in direction 212 during the intake stroke is due to a force applied through crankshaft 222. In one embodiment, a fuel and air mixture is provided through an injector 224. The fuel is provided from a fuel supply, such as a fuel tank, through a fuel rail 226. The air is provided as compressed air through injector 224 and acts as a propellant to assist in atomizing the fuel spray. The air is compressed prior to being provided to fuel injector 224 and is drawn from a compressed air supply, such as an air compressor. In one embodiment, an air compressor is provided as a component of engine 200. In another embodiment, other suitable sources of compressed air are provided. The combustion air is drawn through an air intake 228. Air intake 228 is in fluid communication with combustion chamber 216 through a valve (not shown) which is actuated by a valve assembly 234. Valve assembly 234 normally biases the valve to a closed position resulting in combustion chamber 216 not being in fluid communication with air intake 228.

The intake stroke is followed by a compression stroke wherein the air and fuel present in combustion chamber 216 are compressed. During the compression stroke, piston 210 moves towards top surface 218 of cylinder head 206 in direction 214 thereby reducing the volume of combustion chamber 216 and compressing the air and fuel in combustion chamber 216. The movement of piston 210 in direction 214 during the compression stroke is due to a force applied through crankshaft 222.

The compression stroke is followed by a combustion stroke wherein the fuel and air in combustion chamber 216 are ignited with an igniter 230, illustratively a sparkplug. During the combustion stroke, piston 210 moves away from the top surface 218 of cylinder head 206 in direction 212 due to the expanding gases from the ignition of the fuel and the air. This movement of piston 210 drives crankshaft 222. The driving of crankshaft 222 provides energy to power vehicle 100 and to cause the movement of additional pistons 210 of engine 200 to be moved in direction 212 and/or direction 214.

The combustion stroke is followed by an exhaust stroke wherein the gases produced during the combustion stroke are expelled from combustion chamber 216. During the exhaust stroke, piston 210 moves towards the top surface 218 of cylinder head 206 in direction 214 forcing the gases produced during the combustion stroke out through exhaust manifold 232. Exhaust manifold 232 is in fluid communication with combustion chamber 216 through a valve (not shown) which is actuated by a valve assembly 234. Valve assembly 234 normally biases the valve to a closed position resulting in combustion chamber 216 not being in fluid communication with exhaust manifold 232.

To open the intake valve or exhaust valve, a rocker arm 236 presses on valve assembly 234 resulting in combustion chamber 216 being in fluid communication with air intake 228 during the intake stroke or exhaust manifold 232 during the exhaust stroke. Rocker arm 236 is actuated by a rotating cam 238 through a pushrod 240. Cam 238 is geared to one of crankshaft 222 and a balance shaft 242 such that cam 238 opens the intake valve during the intake stroke and the exhaust valve during the exhaust stroke. Balance shaft 242 is also geared to crankshaft 222 and rotates in an opposite direction compared to a rotation of crankshaft 222 thereby reducing the vibration produced by engine 200.

Although engine 200 is described in relation to a single combustion chamber 216, it should be understood that engine 200 includes multiple combustion chambers 216 each of which receives fuel and air and expels exhaust gases. As is understood in the art, the positioning of the respective pistons 210 in each combustion chamber 216 may be offset and out of phase such that each drives crankshaft 222 at various instances of time, potentially in concert with one or more other pistons 210. Further, crankshaft 222 provides power to traction device 104 through a transmission (not shown).

Crankshaft 222, piston 210, and other moving components below the combustion chamber are lubricated with oil to reduce friction and wear. Oil from crankshaft 222 is recycled by engine 200. The area around crankshaft 222 is separated from an oil sump region 250 by a windage tray 252. Oil may pass through windage tray 252 and enter an oil pump pickup 254. The oil is then filtered through an oil filter 256 and once again introduced to crankshaft 222 and other engine components.

As mentioned above SI fuels have a lower boiling point than CI fuels. The temperature of the oil in oil sump region 250 is generally in the range of 100° C. to 150° C. As such, any SI fuels that may pass out of combustion chamber 216 and into oil sump region 250 by passing between piston 210 and a wall of cylinder 208 are quickly evaporated. However, as mentioned above, CI fuels have a much higher boiling point than SI fuels. As such, CI fuels will not quickly evaporate from sump oil region 250, but rather may cause oil dilution problems, reduced engine performance and potentially engine failure.

Engine 200 includes two additional features to minimize the amount of CI fuel that is communicated from combustion chamber 216 to oil sump region 250. First, piston rings 260 have a higher contact force against the wall of cylinder 208. Exemplary piston rings are designed with greater spring force and reduced thickness to create higher contact forces against the wall of cylinder 208.

Second, piston 210 includes a recess 262 in top portion 204 which will receive any non-ignited fuel. Recess 262 is generally bowl shaped and has a central portion being lower than a periphery portion.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A vehicle for transporting a person, the vehicle including
a chassis,
a traction device adapted to contact the ground and propel the chassis,
a fuel supply supported by the chassis and adapted to receive a SI fuel and a CI fuel, and
a four-stroke engine supported by the chassis and providing power to the traction device, the four-stroke engine having an intake stroke, a compression stroke, a combustion stroke, and an exhaust stroke, the engine having a first operating state running on SI fuel and a second operating state running on CI fuel, the four-stroke engine including
an engine base,
a piston, and
an igniter, the engine base and the piston cooperating to define a combustion chamber in communication with the fuel supply and igniter, wherein a compression ratio of the combustion chamber is the same in the first operating state and the second operating state.

2. The vehicle of claim 1, wherein during the second operating state, the temperature of the CI fuel in the combustion chamber is below an ignition temperature of the CI fuel during the entirety of the compression stroke.

3. The vehicle of claim 1, wherein a compression ratio in the combustion chamber is less than eight to one.

4. The vehicle of claim 1, wherein the engine base includes an engine block and a cylinder head, the cylinder head including the igniter.

5. The vehicle of claim 4, wherein the igniter is an electric igniter and wherein the engine further includes a fuel injector which communicates the CI fuel to the combustion chamber during the second operating state.

6. A vehicle for transporting a person, the vehicle including
a chassis,
a traction device adapted to contact the ground and propel the chassis,
a fuel supply supported by the chassis and adapted to receive a SI fuel and a CI fuel, and
a four-stroke engine supported by the chassis and providing power to the traction device, the four-stroke engine having an intake stroke, a compression stroke, a combustion stroke, and an exhaust stroke, the engine having a first operating state running on SI fuel and a second operating state running on CI fuel, the four-stroke engine including
an engine base, wherein the engine base includes an engine block and a cylinder head,
a piston,
an igniter, the cylinder head including the igniter, the engine base and the piston cooperating to define a combustion chamber in communication with the fuel supply and igniter, wherein the igniter is an electric igniter, the igniter ignites the SI fuel in the first operating state and ignites the CI fuel in the second operating state; and
a fuel injector which communicates the CI fuel to the combustion chamber during the second operating state, a temperature of the CI fuel in the combustion chamber being below an ignition temperature of the CI fuel during an entirety of the compression stroke of the engine, wherein the fuel injector is an air-assist fuel injector and the CI fuel is provided to the combustion chamber along with compressed air.

7. The vehicle of claim 6, wherein a compression ratio in the combustion chamber is up to about eight to one.

8. The vehicle of claim 7, wherein the compression ratio in the combustion chamber is at least about six to one.

9. The vehicle of claim 6, further comprising a straddle-type seat supported by the chassis and a steering device supported by the chassis and coupled to the traction device to steer the vehicle.

10. The vehicle of claim 6, wherein a compression ratio of the combustion chamber is the same in the first operating state and the second operating state.

11. A vehicle for transporting a person, the vehicle including:
a chassis,
a traction device adapted to contact the ground and propel the chassis,
a fuel supply supported by the chassis, and
an engine supported by the chassis, the engine including
an engine base having a cavity disposed therein;
a piston received within the cavity and slideably moveable within the cavity, the piston including a top portion having a periphery and a central section, the central section being lower than the periphery;
a fuel injector configured to introduce a combustible charge into a combustion chamber formed in the cavity between the top portion of the piston and the engine base; and
an igniter in communication with the combustion chamber, the igniter configured to ignite the combustible charge within the combustion chamber, wherein a compression ratio of the engine is the same for both when the combustible charge is a SI fuel and when the combustible charge is a CI fuel.

12. The vehicle of claim 11, wherein the combustible charge includes a SI fuel and the compression ratio of the engine is up to about eight to one.

13. The vehicle of claim 11, further comprising a controller operably coupled to the fuel injector and the igniter and configured to time the introduction of the combustible charge into the combustion chamber and the ignition of the combustible charge with the igniter and a sensor configured to provide an indication to the controller of a fuel type present in the combustion charge.

14. The vehicle of claim 11, wherein the combustible charge includes a CI fuel and the compression ratio of the engine is up to about eight to one.

15. The vehicle of claim 14, wherein the compression ratio is at least about six to one.

16. The vehicle of claim 13, further comprising a user input which provides an indication to the controller of a fuel type present in the combustion charge.

17. The vehicle of claim 16, wherein the user input provides a first setting corresponding to an SI fuel and a second setting corresponding to a CI fuel.

18. The vehicle of claim 11, wherein the engine is a four-stroke engine.

19. The vehicle of claim 11, wherein the engine has a first operating state running on a SI fuel and a second operating state running on a CI fuel, a compression ratio in the combustion chamber of up to about eight to one.

20. The vehicle of claim 19, wherein during the second operating state, the temperature of the CI fuel in the combustion chamber is below an ignition temperature of the CI fuel during the entirety of a compression stroke of the engine.

21. The vehicle of claim 19, wherein the compression ratio in the combustion chamber is at least about six to one.

22. The vehicle of claim 12, wherein the combustible charge is compressed by the piston in the combustion chamber.

23. The vehicle of claim 14, wherein the combustible charge is compressed by the piston in the combustion chamber.

24. A method of operating an engine, the method including the steps of:

moving a piston away from a top portion of a combustion chamber and introducing a combustible charge into the combustion chamber during an intake stroke;

moving the piston towards the top portion of the combustion chamber during a compression stroke;

igniting the combustible charge in the combustion chamber with an igniter thereby moving the piston away from the top portion of the combustion chamber during a combustion stroke, the combustible chamber having a compression ratio of up to about eight to one; and moving the piston towards the top portion of the combustion chamber during an exhaust stroke, wherein the compression ratio of the combustion chamber is the same for both when the combustible charge is a SI fuel and when the combustible charge is a CI fuel.

25. The method of claim 24, wherein the combustible charge includes a CI fuel and a temperature of the CI fuel in the combustion chamber is below an ignition temperature of the CI fuel during the entirety of the compression stroke of the engine.

26. The method of claim 24, wherein the combustible charge includes a first portion which is burned during the combustion stroke and a second portion of the combustible charge which is received in a recess of the piston.

27. The method of claim 24, wherein the compression ratio in the combustion chamber is in the range of about six to one to about eight to one.

28. A method of operating an engine, the method including the steps of:

introducing a charge into a combustion chamber of the engine, the charge including a SI fuel in a first operating state of the engine and including a CI fuel in a second operating state of the engine;

igniting a first portion of the charge in the combustion chamber with an igniter in both the first operating state and the second operating state without igniting a second portion of the charge in the combustion chamber;

exhausting gases generated from the previously ignited first portion of the charge from the combustion chamber; and receiving the second portion of the charge in a recess in a top portion of a piston which bounds the combustion chamber, the igniter being positioned directly above the top portion of the piston.

29. The method of claim 28, further comprising the step of determining if the charge is a CI fuel or a SI fuel.

30. The method of claim 28, wherein the charge is a CI fuel.

31. The method of claim 30, wherein the charge is compressed in the combustion chamber prior to igniting the first portion of the charge, a compression ratio of the combustion chamber being up to about eight to one.

32. The method of claim 31, wherein the compression ratio of the combustion chamber is at least about six to one.

33. A method of operating an engine, the method including the steps of:

receiving an indication of a fuel type being provided to a combustion chamber of the engine, the fuel type being a SI fuel in a first operating state of the engine and a CI fuel in a second operating state of the engine;

compressing a charge in the combustion chamber, a compression ratio of the combustion chamber being up to about eight to one and being constant independent of fuel type and the operating state of the engine; and igniting the compressed fuel in the combustion chamber.

34. The method of claim 33, wherein the indication of the fuel type is provided by a sensor.

35. The method of claim 33, wherein the compression ratio is at least about six to one.

* * * * *